US010007289B2

(12) United States Patent
Tanimoto et al.

(10) Patent No.: US 10,007,289 B2
(45) Date of Patent: Jun. 26, 2018

(54) HIGH PRECISION VOLTAGE REFERENCE CIRCUIT

(71) Applicant: Dialog Semiconductor (UK) Limited, London (GB)

(72) Inventors: Susumu Tanimoto, Tokyo (JP); Soichiro Ohyama, Kanagawa (JP)

(73) Assignee: Dialog Semiconductor (UK) Limited, London (GB)

( * ) Notice: Subject to any disclaimer, the term of this patent is extended or adjusted under 35 U.S.C. 154(b) by 0 days. days.

(21) Appl. No.: 15/340,200

(22) Filed: Nov. 1, 2016

(65) Prior Publication Data

US 2018/0120887 A1 May 3, 2018

(51) Int. Cl.
*G05F 3/26* (2006.01)

(52) U.S. Cl.
CPC ..... *G05F 3/262* (2013.01)

(58) Field of Classification Search
CPC ..... G05F 3/18; G05F 3/22; G05F 3/30; G05F 3/247; G05F 3/245; G05F 3/262; G05F 3/265; G05F 1/56
USPC ..... 323/311–317
See application file for complete search history.

(56) References Cited

U.S. PATENT DOCUMENTS 4,559,694 A 12/1985 Yoh et al.
5,311,115 A 5/1994 Archer
5,376,839 A 12/1994 Horiguchi et al.
5,384,740 A 1/1995 Etoh et al.
5,760,639 A * 6/1998 Hall ..... G05F 3/30 323/314
6,535,435 B2 3/2003 Tanaka et al.
2004/0008080 A1* 1/2004 Nagaya ..... G05F 3/267 327/543
2004/0164790 A1* 8/2004 Moon ..... G05F 3/262 327/546
2007/0164722 A1 7/2007 Rao et al.
2014/0103900 A1* 4/2014 Lahiri ..... G05F 3/24 323/313
2015/0002131 A1* 1/2015 Takada ..... H03F 3/345 323/313

OTHER PUBLICATIONS

"CMOS Voltage Reference Based on Gate Work Function Differences in Poly-Si Controlled by Conductivity Type and Impurity Concentration," by Hirobumi Watanabe et al., IEEE Journal of Solid-State Circuits, vol. 38, No. 6, Jun. 2003, pp. 987-994.
"MOS Voltage Reference Based on Polysilicon Gate Work Function Difference," by Henri J. Oguey et al, IEEE Journal of Solid-State Circuits, vol. SC-15, No. 3, June 1980, pp. 264-269.
German Search Report, Application No. 10 2017 202 091.1, Applicant: Dialog Semiconductor (UK) Limited, dated Apr. 27, 2017, 9 pgs, and English language translation, 11 pgs.
"CMOS Analog Integrated Circuits BAsed on Weak Inversion Operation," by Eric Vittoz et al., IEEE Journal of Solid-State Circuits, vol. SC-12, No. 3, Jun. 1977, pp. 224-231.

* cited by examiner

*Primary Examiner* — Yemane Mehari
(74) *Attorney, Agent, or Firm* — Saile Ackerman LLC; Stephen B. Ackerman

(57) ABSTRACT

A high precision voltage reference circuit is disclosed which replaces two current bias sources, with a single current mirror. Curvature-error correction is established with a modified current mirror circuit. Another object of this disclosure is the addition of a MOSFET device, to alleviate the output voltage variation, due to the channel modulation effect of the origin of the voltage reference.

23 Claims, 7 Drawing Sheets

HIGH PRECISION VOLTAGE REFERENCE CIRCUIT

BACKGROUND

Field

The disclosure relates generally to a low current, small-size voltage reference.

Description of Related Art

FIG. 1 illustrates 100, a MOS voltage reference based on a polysilicon gate, of the prior art. The voltage reference, shown in IEEE Journal of Solid-State Circuit Volume SC-15, No. 3, June 1980, is comprised of six MOSFET devices—T1, T2, T5, T7, T8, and T9—which have precisely matching electrical properties among them, to get high precision voltage reference output VR. In order to realize this accurate matching, the six MOSFET devices need to be large enough to alleviate random variation effect. In addition, devices T1 and T2, which have threshold voltage difference between them becoming the origin of the voltage reference, suffer mismatching due to the voltage difference of their drain voltages.

SUMMARY

An object of the disclosure is a high precision voltage reference circuit, implemented with a single current mirror.

Further, another object of this disclosure is curvature-error correction, established with a modified current mirror circuit.

Still, another object of this disclosure is the addition of a MOSFET device, to alleviate the output voltage variation, due to the channel modulation effect of the origin of the voltage reference.

To accomplish the above and other objects, a high precision voltage reference circuit is disclosed, comprised of a first NMOS and second NMOS device, a resistor, and a current mirror circuit. The drain of the first NMOS device and the gates of the first and the second NMOS device are connected. The backgate and the source of the second NMOS device are connected at an output node. A resistor is connected to the output node, to modify the output of the current mirror. The devices of the current mirror circuit are matched device pairs.

The above and other objects are further achieved by a method for a high precision voltage reference circuit. The steps include providing a voltage reference circuit with a single current mirror. Modifying the output of the current mirror, to achieve the appropriate ratio of current flowing through the devices of the current mirror, is provided. A high precision voltage is achieved, by matching device pairs of the current mirror. The output voltage variation is alleviated, due to the channel modulation effect of the origin of the voltage reference.

In various embodiments the function may be achieved by implementing a current mirror comprised of two PMOS devices.

In various embodiments, the function may be achieved by implementing a current mirror configured to make the output voltage temperature coefficient smaller.

In various embodiments, the function may be achieved by implementing a current mirror comprised of three PMOS devices and a resistor.

In various embodiments, the function may be achieved by implementing a current mirror comprised of two PMOS devices and an NMOS device.

In various embodiments, the function may be achieved by implementing a current mirror comprised of two PMOS devices and a low threshold voltage NMOS device.

In various embodiments, the function may be achieved by implementing a current mirror comprised of two PMOS devices and an NMOS device, the bulk node of the NMOS device connected to its source node.

In various embodiments, the function may be achieved by implementing a current mirror comprised of four PMOS devices.

In various embodiments, the function may be achieved by implementing a current mirror comprised of four PMOS devices, the four PMOS devices sharing a gate connection.

In various embodiments, the function may be achieved by implementing a current mirror comprised of four PMOS devices, the four PMOS devices sharing a gate connection with the drain of the fourth PMOS device.

In various embodiments, the function may be achieved by implementing a current mirror comprised of five PMOS devices and a resistor.

DETAILED DESCRIPTION

The present disclosure is relevant to a high precision voltage reference circuit using a threshold voltage difference between a pair of MOSFET devices, to improve the curvature error.

Figure 2:
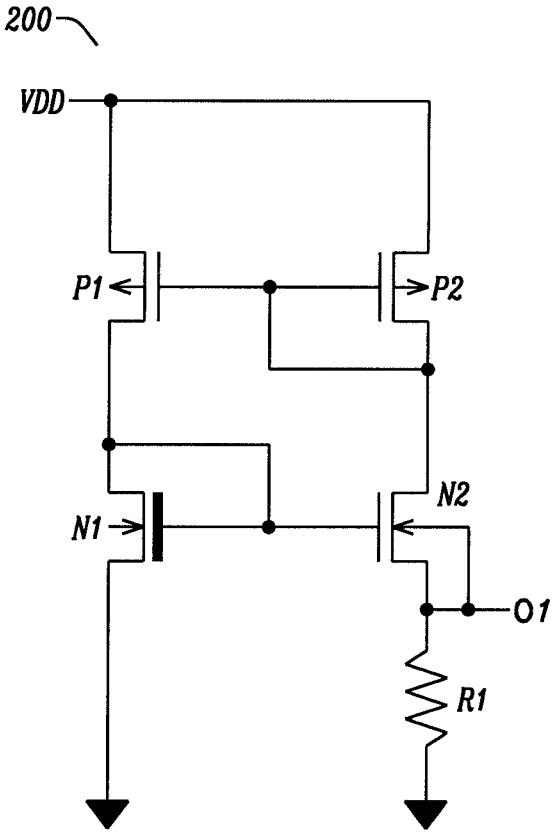
FIG. 2 shows a first basic embodiment of the disclosure, where a current mirror of a high precision voltage reference circuit is comprised of two PMOS devices.

FIG. 2 shows 200 a first basic embodiment of the disclosure, where a current mirror is comprised of two PMOS devices. The threshold voltage of device N1 is higher than that of N2, and the ratio of current flowing through N1 and N2 is properly controlled. The difference between the threshold voltages appears at output node O1, the source of device N2, with small variation in temperature. In the prior art, the appropriate current ratio is realized with a second current source circuit. In this first basic embodiment of the disclosure, a second current source circuit is not required. Resistor R1, at output node O1, has a value that is appropriately chosen used to form the appropriate ratio of current flowing through devices N1 and N2 of the current mirror.

Figure 1:
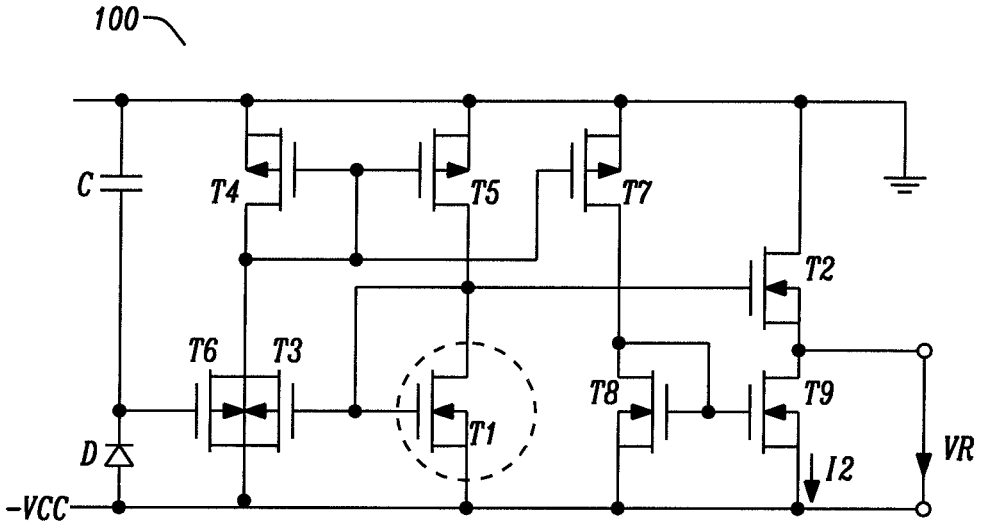
FIG. 1 illustrates a MOS voltage reference base on a polysilicon gate, of the prior art.

To obtain a high precision output voltage, matching device pairs N1 and N2, and P1 and P2 of the current mirror, is required. Their sizes may be large to decrease random variation. The prior art of FIG. 1 requires four matching pairs of devices, T1/T2, T4/T5, T4/T7 and T8/T9. In the embodiment of FIG. 2, only two matching pairs of devices are required. A high precision voltage reference circuit, with a smaller area and a more accurate output voltage, is achieved.

Figure 3:
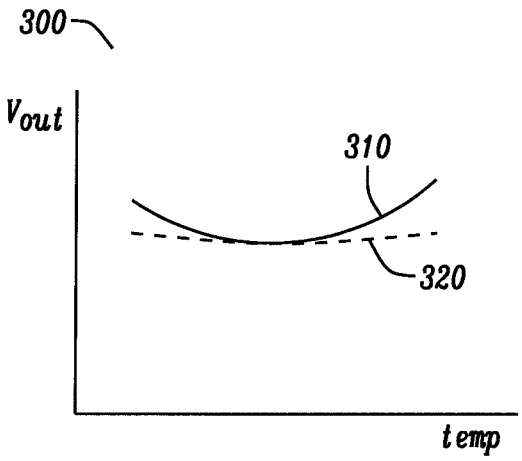
FIG. 3 illustrates output voltage versus temperature, with a $2^{nd}$ order negative temperature coefficient.

FIG. 3 illustrates 300, output voltage versus temperature, with a $2^{nd}$ order negative temperature coefficient. The output voltage of the disclosure of FIG. 2 usually has a $2^{nd}$ order positive temperature coefficient. This is in contrast with the usual band gap reference circuit using bipolar transistors. The output voltage with a $2^{nd}$ order positive temperature coefficient is shown in 310. The usual bandgap reference circuit using bipolar transistors is shown in 320.

Figure 4:
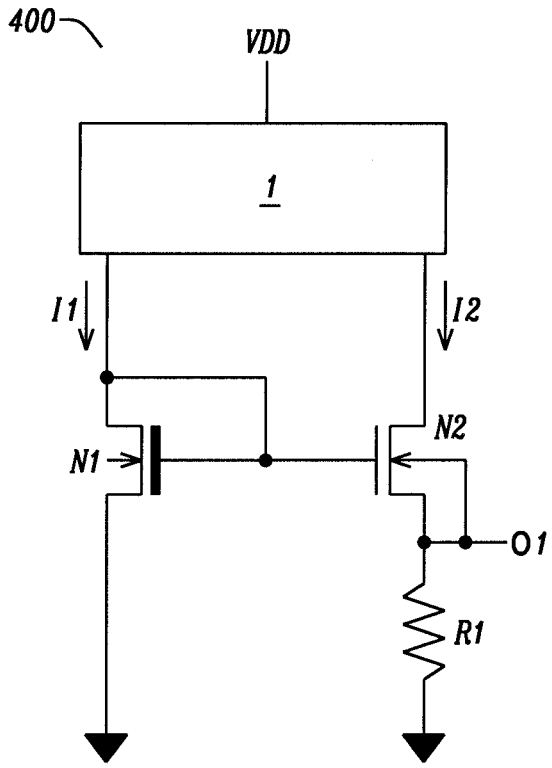
FIG. 4 shows a second embodiment of the disclosure, where a current mirror of a high precision voltage reference circuit is configured to make the output voltage temperature coefficient smaller.

FIG. 4 shows 400 a second embodiment of the disclosure, where a current mirror is configured to make the output voltage temperature coefficient smaller. This is the case where the curvature error is improved, and the output voltage has a $2^{nd}$ order positive temperature coefficient as shown in FIG. 3. Current mirror circuit 1, input current I2, and output current I1 are shown. A specific feature of the current mirror in this embodiment, formed by current mirror circuit 1, is that the current ratio of I1/I2 has a negative temperature coefficient at high temperature. As a result, the temperature coefficient of the output voltage O1 at high temperature decreases and is more close to zero.

Figure 5:
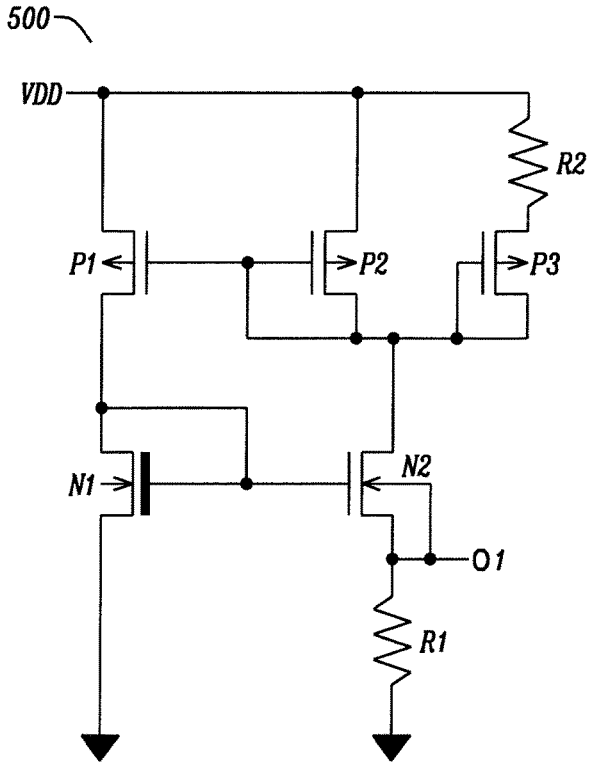
FIG. 5 illustrates an example of the second embodiment of the disclosure, where the current mirror circuit is comprised of three PMOS devices and a resistor.

FIG. 5 illustrates 500 an example of the second embodiment of the disclosure, where the current mirror circuit is comprised of three PMOS devices and a resistor. The (gate width)/(gate length) ratio of device P3 is greater than that of P2. If the temperature increases, the current flowing in resistor R2 and P3 increases, due to a decrease in threshold voltage. This means that the current mirror ratio on the PMOS devices, (current flowing on P1)/[(current flowing on P2)+(current flowing on P3)], decreases with increasing temperature. This embodiment prevents the output voltage increasing at high temperatures, and gives a more flattened output voltage versus temperature than the disclosure in FIG. 2.

Figure 6:
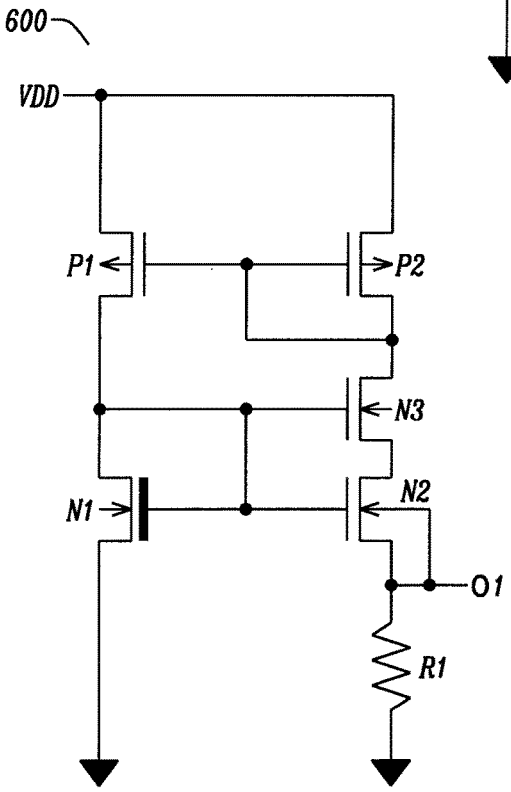
FIG. 6 shows a third embodiment of the disclosure, where a current mirror of a high precision voltage reference circuit is comprised of two PMOS devices and an NMOS device, and the bulk node of the NMOS device is connected to ground.

FIG. 6 shows 600 a third embodiment of the disclosure, where a current mirror is comprised of two PMOS devices and an NMOS device, and the bulk node of the NMOS device is connected to ground. Device N3 has been added to the circuit of FIG. 2 and serves to operate as a cascode device. The drain node impedance of N3 becomes higher than that of the drain node impedance of device N2 without N3. The voltage between the source and drain of N2 is limited by N3, and the channel modulation effect on N2 is prevented. These two effects of N3 improve the variation of output voltage O1 due to any increase in VDD.

Figure 7:
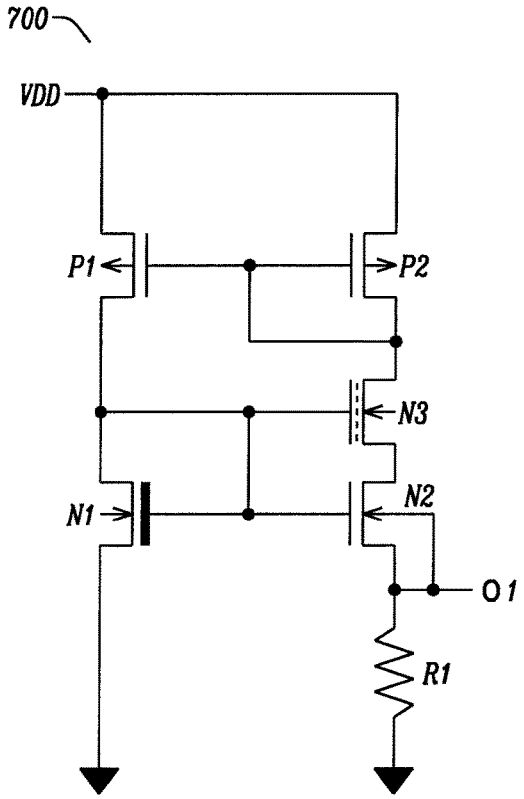
FIG. 7 illustrates a fourth embodiment of the disclosure, where a current mirror of a high precision voltage reference circuit is comprised of two PMOS devices and a low threshold voltage NMOS device.

FIG. 7 illustrates 700 a fourth embodiment of the disclosure, where a current mirror is comprised of two PMOS devices and a low threshold voltage NMOS device. Low threshold voltage NMOS device N3 allows nearly the same (gate width)/(gate length) ratio as device N2, and the overall device area can be made smaller. If a normal enhancement NMOS device were used for N3, the (gate width)/(gate length) ratio would be significantly greater than that of N2.

Figure 8:
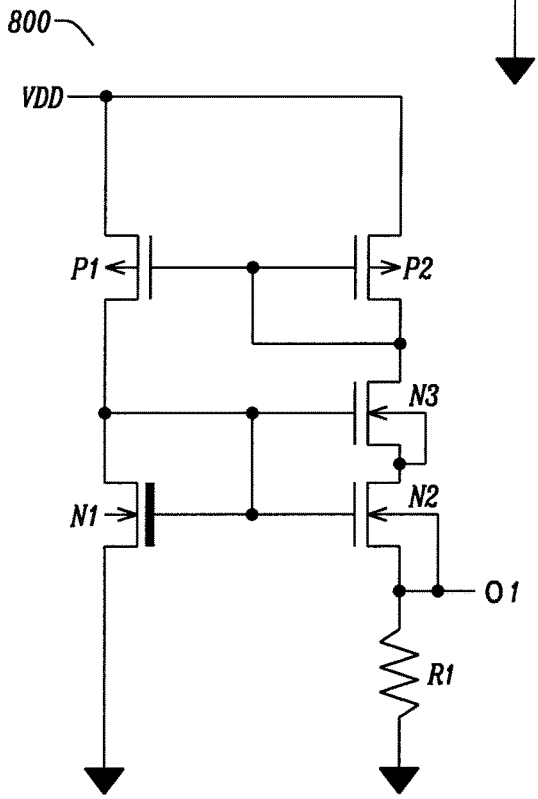
FIG. 8 shows a fifth embodiment of the disclosure, where a current mirror of a high precision voltage reference circuit is comprised of two PMOS devices and an NMOS device, and the bulk node of the NMOS device is connected to its source node.

FIG. 8 shows 800 a fifth embodiment of the disclosure, where a current mirror of a high precision voltage reference circuit is comprised of two PMOS devices and an NMOS device, and the bulk node of the NMOS device is connected to its source node. If the bulk node of NMOS device N3 is connected to its source node, then the (gate width)/(gate length) ratio of N3 can be made even smaller. In FIG. 6, where the bulk node of NMOS device N3 is connected to ground, the threshold voltage of N3 must be increased. In FIG. 8, where the bulk node of NMOS device N3 is connected to its source node, there is no increase in the threshold voltage of N3.

The embodiments of the disclosure in FIGS. 6 and 8 use a cascode connection between the NMOS devices. If a cascode connection is used between the PMOS devices, the accuracy of output voltage O1 is still further improved. This is seen in the examples of FIGS. 9 and 10.

Figure 9:
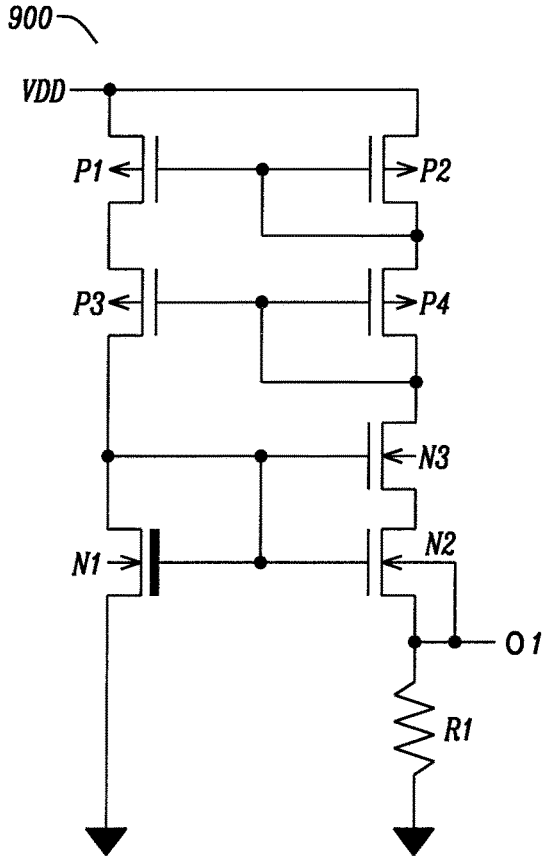
FIG. 9 illustrates a sixth embodiment of the disclosure, where a current mirror of a high precision voltage reference circuit is comprised of four PMOS devices.

FIG. 9 illustrates 900 a sixth embodiment of the disclosure, where a current mirror of a high precision voltage reference circuit is comprised of four PMOS devices. The drain of P1 is the source of P3, and the drain of P2 is the source of P4. The gate of P3 and P4 is the drain of P4, and there is no restriction on sizes of P3 and P4. Device N3 operates as a cascode device and the channel modulation effect on N2 is prevented. The accuracy of output voltage O1, the voltage reference, is improved due to the configuration of the drain voltages.

Figure 10:
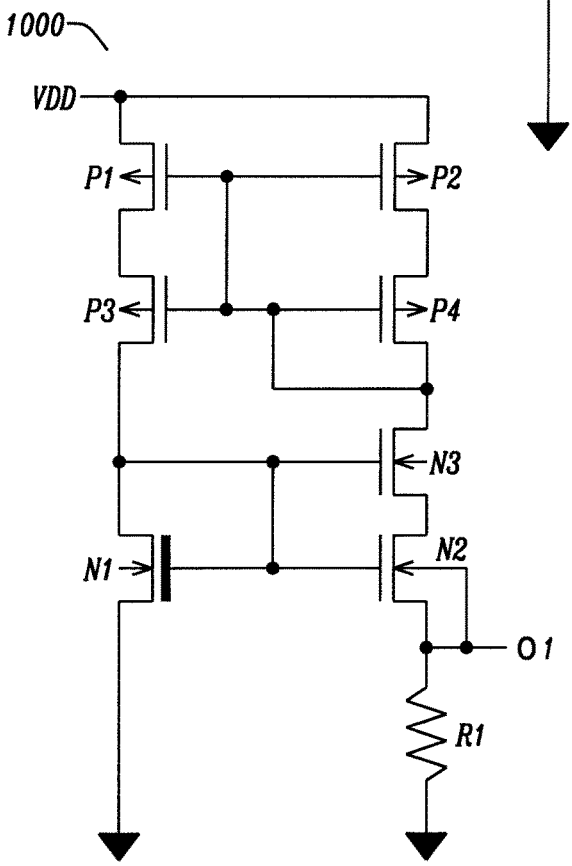
FIG. 10 shows an example of a sixth embodiment of the disclosure, where a current mirror of a high precision voltage reference circuit is comprised of four PMOS devices, and the four PMOS devices share a gate connection.

FIG. 10 shows 1000 an example of a sixth embodiment of the disclosure, where a current mirror of a high precision voltage reference circuit is comprised of four PMOS devices, and the four PMOS devices share a gate connection. The minimum operation voltage of FIG. 10 is lower than that of FIG. 9, and the (gate width)/(gate length) ratios of PMOS devices P3 and P4 are larger than PMOS devices P1 and P2. Since the bulk node of NMOS device N3 is connected to its source node, there is no increase in the threshold voltage of N3.

Figure 11:
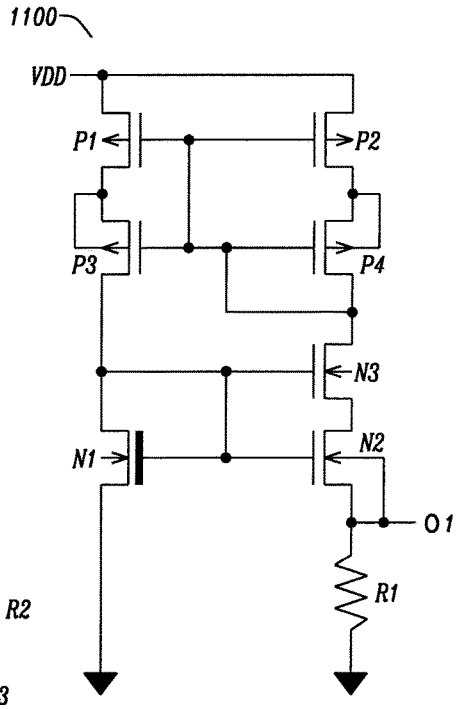
FIG. 11 illustrates another example of a sixth embodiment of the disclosure, where a current mirror of a high precision voltage reference circuit is comprised of four PMOS devices, and the four PMOS devices share a gate connection with the drain of the fourth PMOS device.

FIG. 11 illustrates 1100 another example of a sixth embodiment of the disclosure, where a current mirror of a high precision voltage reference circuit is comprised of four PMOS devices, and the four PMOS devices share a gate connection with the drain of the fourth PMOS device. The bulk nodes of PMOS devices P3 and P4 are connected to the sources of P3 and P4, respectively. The (gate width)/(gate length) ratios of PMOS devices P3 and P4 are smaller than those of FIG. 10 an the minimum operation voltage is also lower.

Figure 12:
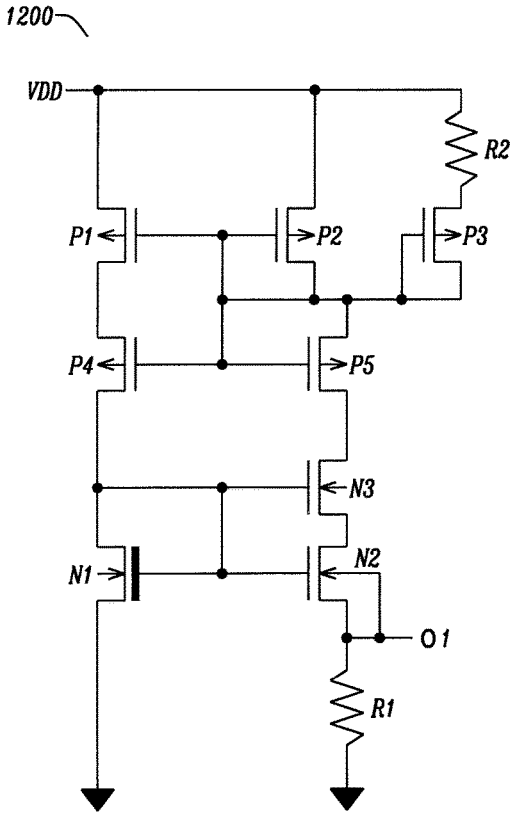
FIG. 12 shows a seventh embodiment of the disclosure, where a current mirror of a high precision voltage reference circuit is comprised of five PMOS devices and a resistor.

FIG. 12 shows 1200 a seventh embodiment of the disclosure, where a current mirror of a high precision voltage reference circuit is comprised of five PMOS devices and a resistor. This embodiment is a variant of FIG. 5, where the (gate width)/(gate length) ratio of device P3 is greater than that of P2, and the current flowing in resistor R2 and P3 increases with temperature, due to decreasing threshold voltage. FIG. 12 uses the same cascode connection as described in FIG. 10, where the (gate width)/(gate length) ratios of PMOS devices P4 and P5 are larger than PMOS devices P1 and P2. Other techniques described in FIG. 6, FIG. 7, FIG. 8, FIG. 9 and FIG. 11 can be combined with the embodiment of FIG. 12, as well.

Figure 13:
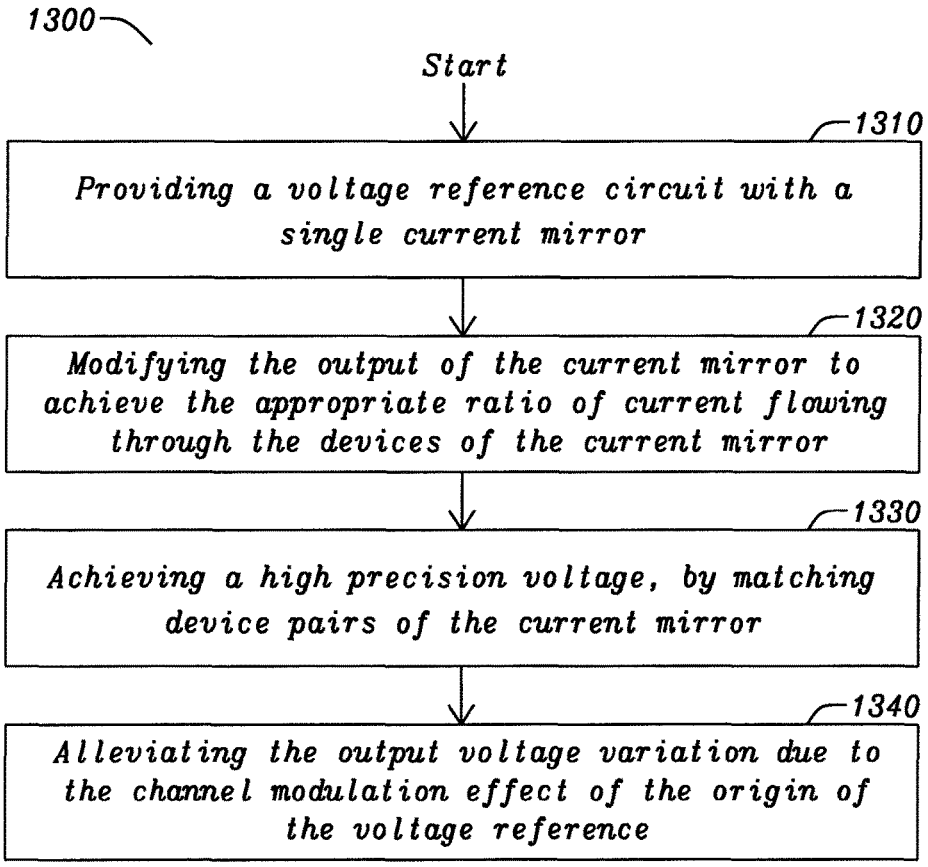
FIG. 13 shows a method for a high precision voltage reference circuit, embodying the principles of the disclosure.

FIG. 13 shows flowchart 1300 of a method for a high precision voltage reference circuit, embodying the principles of the disclosure. Step 1310 shows providing a voltage reference circuit with a single current mirror. Step 1320 shows modifying the output of the current mirror, to achieve the appropriate ratio of current flowing through the devices of the current mirror. Step 1330 shows achieving a high precision voltage, by matching device pairs of the current mirror. Step 1340 shows alleviating the output voltage variation, due to the channel modulation effect of the origin of the voltage reference.

The advantages of one or more embodiments of the present disclosure include increased precision in the voltage reference circuit by decreasing sources of error. The smaller size of the voltage reference circuit, and less dependency on the power supply voltage, lead to an overall improvement in system performance.

While this invention has been particularly shown and described with reference to the preferred embodiments thereof, it will be understood by those skilled in the art that various changes in form and details may be made without departing from the spirit and scope of the invention.

The invention claimed is:

1. A high precision voltage reference circuit, comprising:

a first and second NMOS device, wherein the drain of said first NMOS device and the gates of said first and said second NMOS device are connected, and the gate and the source of said second NMOS device are connected at an output node;

a current mirror circuit, wherein said current mirror circuit supplies a first current to said drain and gate of said first NMOS device, and a second current to the drain of said second NMOS device; and a resistor, wherein said resistor is connected to said output node, to modify the output of said current mirror.

2. The high precision voltage reference circuit of claim1, wherein the devices of said current mirror circuit are matched device pairs.

3. The high precision voltage reference circuit of claim 1, wherein said current mirror circuit is comprised of two PMOS devices, said PMOS device gates connected to the drain of the second said PMOS device.

4. The high precision voltage reference circuit of claim 1, wherein said current mirror circuit is a single current mirror configured to reduce the output voltage temperature coefficient.

5. The high precision voltage reference circuit of claim 1, wherein said current mirror circuit is comprised of three PMOS devices, said PMOS device gates connected to the drain of the second and the third said PMOS device, and a resistor.

6. The high precision voltage reference circuit of claim 1, wherein said current mirror circuit is comprised of two PMOS devices and an NMOS device, configured to prevent channel modulation.

7. The high precision voltage reference circuit of claim 1, wherein said current mirror circuit is comprised of two PMOS devices and a low threshold voltage NMOS device, configured to shrink device area.

8. The high precision voltage reference circuit of claim 1, wherein said current mirror circuit is comprised of two PMOS devices and an NMOS device, the bulk node of said NMOS device connected to the source node of said NMOS device.

9. The high precision voltage reference circuit of claim 1, wherein said current mirror circuit is comprised of four PMOS devices, connected in a cascode manner.

10. The high precision voltage reference circuit of claim 1, wherein said current mirror circuit is comprised of four PMOS devices, said four PMOS devices connected at said PMOS device gates.

11. The high precision voltage reference circuit of claim 1, wherein said current mirror circuit is comprised of four PMOS devices, said PMOS devices connected at said PMOS device gates and the drain of said fourth PMOS device.

12. The high precision voltage reference circuit of claim 1, wherein said current mirror circuit is comprised of five PMOS devices and a resistor, configured to prevent the output voltage from increasing at high temperatures.

13. A method for a high precision voltage reference circuit, comprising:

providing a voltage reference circuit with a single current mirror;

modifying the output of said current mirror, to achieve the appropriate ratio of current flowing through the devices of said current mirror;

achieving a high precision voltage, by matching device pairs of said current mirror; and alleviating the output voltage variation, due to the channel modulation effect of the origin of said voltage reference.

14. The method of claim 13, wherein said single current mirror has two PMOS devices, sharing their gates with the drain of the second said PMOS device.

15. The method of claim 13, wherein said single current mirror reduces the output voltage temperature coefficient.

16. The method of claim 13, wherein said single current mirror has three PMOS devices, sharing their gates with the drain of the second and third said PMOS devices, and a resistor.

17. The method of claim 13, wherein said single current mirror has two PMOS devices and an NMOS device, preventing channel modulation.

18. The method of claim 13, wherein said single current mirror has two PMOS devices and a low threshold voltage NMOS device, shrinking the device area.

19. The method of claim 13, wherein said single current mirror has two PMOS devices and an NMOS device, connecting the bulk node of said NMOS device to said NMOS device source node.

20. The method of claim 13, wherein said single current mirror has four PMOS devices, using a cascode connection.

21. The method of claim 13, wherein said single current mirror has four PMOS devices, sharing a gate connection.

22. The method of claim 13, wherein said single current mirror has four PMOS devices, sharing a gate connection with the drain of said fourth PMOS device.

23. The method of claim 13, wherein said single current mirror has five PMOS devices and a resistor, preventing the output voltage to increase at high temperatures.

* * * * *